United States Patent [19]

Schneider et al.

[11] 4,217,106

[45] Aug. 12, 1980

[54] ALKALINE BATHS CONTAINING ALKENE SULFONATES AS WETTING AGENTS

[75] Inventors: Wolfgang Schneider, Marl; Ferdinand Von Praun, Haltern; Kurt Niehaves, Marl, all of Fed. Rep. of Germany

[73] Assignee: Chemische Werke Hüls A.G., Marl, Fed. Rep. of Germany

[21] Appl. No.: 787,052

[22] Filed: Apr. 13, 1977

[30] Foreign Application Priority Data

May 6, 1976 [DE] Fed. Rep. of Germany ..... 2620014

[51] Int. Cl.[2] ..... D06M 1/02

[52] U.S. Cl. ..... 8/127; 8/116 R; 8/125

[58] Field of Search ..... 8/125, 127, 116 R

[56] References Cited

U.S. PATENT DOCUMENTS 2,061,618 11/1936 Downing et al. ..... 252/353 X

FOREIGN PATENT DOCUMENTS 1154460 9/1963 Fed. Rep. of Germany .
1270549 6/1968 Fed. Rep. of Germany ..... 260/513 R
2164235 6/1973 Fed. Rep. of Germany .
1389312 4/1975 United Kingdom .

OTHER PUBLICATIONS

Yamane, I. et al. "Olefin Sulfonates IV Correlation Between Carbon Chain Length and Surface-Active Properties of Alpha-Olefin Sulfonates," Chem. Abs. 1970, 73, (16), 78815w.

*Primary Examiner*—A. Lionel Clingman
*Attorney, Agent, or Firm*—Gilbert L. Wells

[57] ABSTRACT

The mercerizing of cellulose fibers is improved by using an aqueous alkaline bath composition having as a wetting agent alkali salts of alkene sulfonic acids having 6 to 10 carbon atoms and single or double branched structures in a concentration of about 1 to 5 grams per liter of bath composition.

9 Claims, 5 Drawing Figures

Shrinkage %

(based on initial yarn length)

ALKALINE BATHS CONTAINING ALKENE SULFONATES AS WETTING AGENTS

CROSS-REFERENCE TO A RELATED APPLICATION

Applicants claim priority under 35 USC 119 for application P 26 20 014.6 filed May 6, 1976, in the Patent Office of the Federal Republic of Germany.

BACKGROUND OF THE INVENTION

The field of the invention is compositions for mercerizing cellulose fibers.

The mercerizing of cellulose fibers is a well-known operation during textile finishing.

The mercerizing step imparts to the cellulose fibers increased luster, improved dyeability, higher tear strength, better moisture absorption, and higher lightfastness and weathering resistance.

The mercerizing process resides in treating the cellulose containing fiber material, which is under tension, with alkali solutions of a high concentration at predominantly low temperatures.

In order to have the mercerizing procedure take place rapidly, thus ensuring a high throughput and a satisfactory economy of the processes, the fiber must be soaked quickly and uniformly with the alkali solution.

Since high-percentage alkali hydroxide solutions exhibit a high surface tension, the use of wetting agents is ncessary. It has been known to add phenols and phenol derivatives to the mercerizing solution (see Lindner, "Tenside-Textilhilfsmittel-Waschrohstoffe" [Tensides—Auxiliary Textile Agents—Detergent Raw Materials] [1964] vol. II, pp. 1,476–1,478). The phenolates formed in the alkali solution actually are not as yet wetting agents, but they act as hydrotropic compounds and emulsifiers on the actual active agents causing the wetting effect. Such active agents are, for example, alkanesulfonates and alkyl sulfates.

Compositions containing phenol and phenol derivatives have only little significance nowadays due to the large amounts which must be employed (10-20 g./l.) and due to the troublesome odor, and they are no longer used, above all, because the phenols are considerably toxic to fish.

However, phenol-free mercerizing agents are likewise known. These are primarily alkanesulfonates and alkyl sulfates as disclosed in German Published Application No. 1,154,460, as well as mixtures thereof, as they are available in several known commercial products. These prior-art agents impart a certain wettability to the highly concentrated solutions of alkali, but this wettability is not as yet fully satisfactory. Furthermore, the solubility of the agents of the prior art in highly concentrated alkali solutions is not always adequate.

SUMMARY OF THE INVENTION

Having in mind the limitations of the prior art, it has now been discovered that these disadvantages of the prior art are overcome by using as the wetting agents the alkali salts of branched alkene sulfonic acids having not more than two branches containing 6–10 carbon atoms in aqueous alkaline baths containing 100–450 grams per liter of sodium hydroxide, potassium hydroxide and/or lithium hydroxide, in amounts of 1–5 grams of alkene sulfonate per liter of bath liquor. In particular, the alkali solutions contain 330–450 grams per liter of alkali hydroxide.

Preferably, alkene sulfonates which contain 7–9 carbon atoms are utilized.

In another preferred embodiment of the process according to the present invention, 2–3 grams of alkene sulfonate is used per liter of bath liquor. Especially preferred is the use of the alkali salts of alkene sulfonic acids prepared from tripropylene, 2-ethylhexene, 3-methyl-2-heptene, 3-methyl-3-heptene, or mixtures thereof.

It is advantageous to employ, in addition to the alkene sulfonate of this invention, products which are effective as hydrotropic agents, emulsifiers, defrothers, etc.

Under practical conditions, for example, such products are alcohols and alcohol derivatives, carboxylic acids, amines, etc.

BRIEF DESCRIPTION OF THE DRAWINGS

The figures of the drawings appended hereto are graphical representations of data taken from the tables which follow, wherein.

DESCRIPTION OF THE PREFERRED EMBODIMENTS

The steps according to the present invention provide the surprising commercial advantage, as compared to the state of the art, of appreciably raising the wettability of highly concentrated alkali solutions, as can be derived from Tables 1-8, especially from Tables 3,4,7, and 8 which follow.

The shrinkage of the yarn length and/or the final shrinkage is markedly higher with the use of high alkali solution concentrations after the treatment of the present invention than with the use of the agents of the prior art.

Tables 1–8 also show that the teaching of the present invention is critical to a high degree: unbranched sulfonates, as well as those having more than two branchings and sulfonates of more than 10 carbon atoms, do not exhibit the desired effect.

Figure 1:
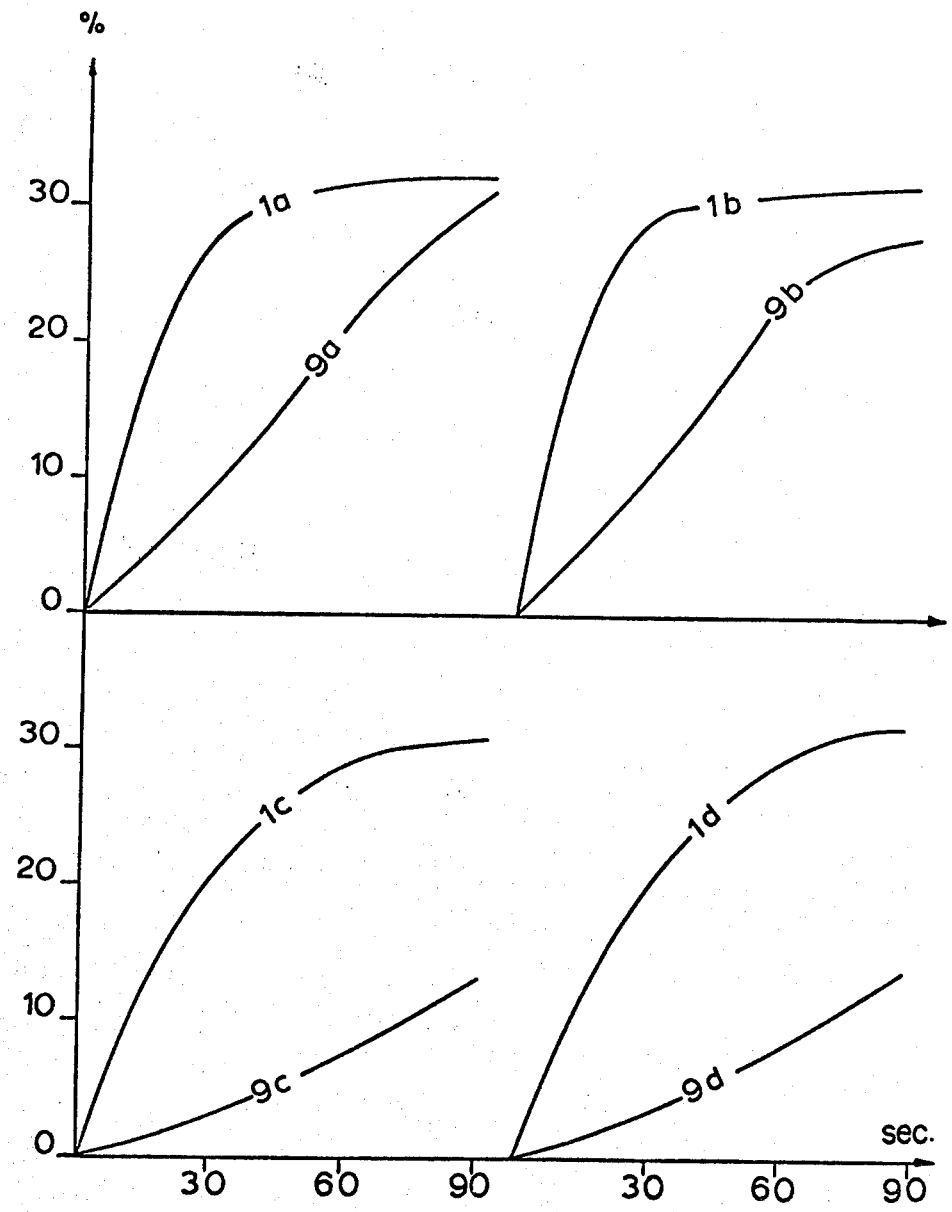
FIG. 1 is an X-Y plot of the data for percentage shrinkage per second based on initial yarn length for the present invention versus the prior art as taken from Tables 1–4.
Figure 2:
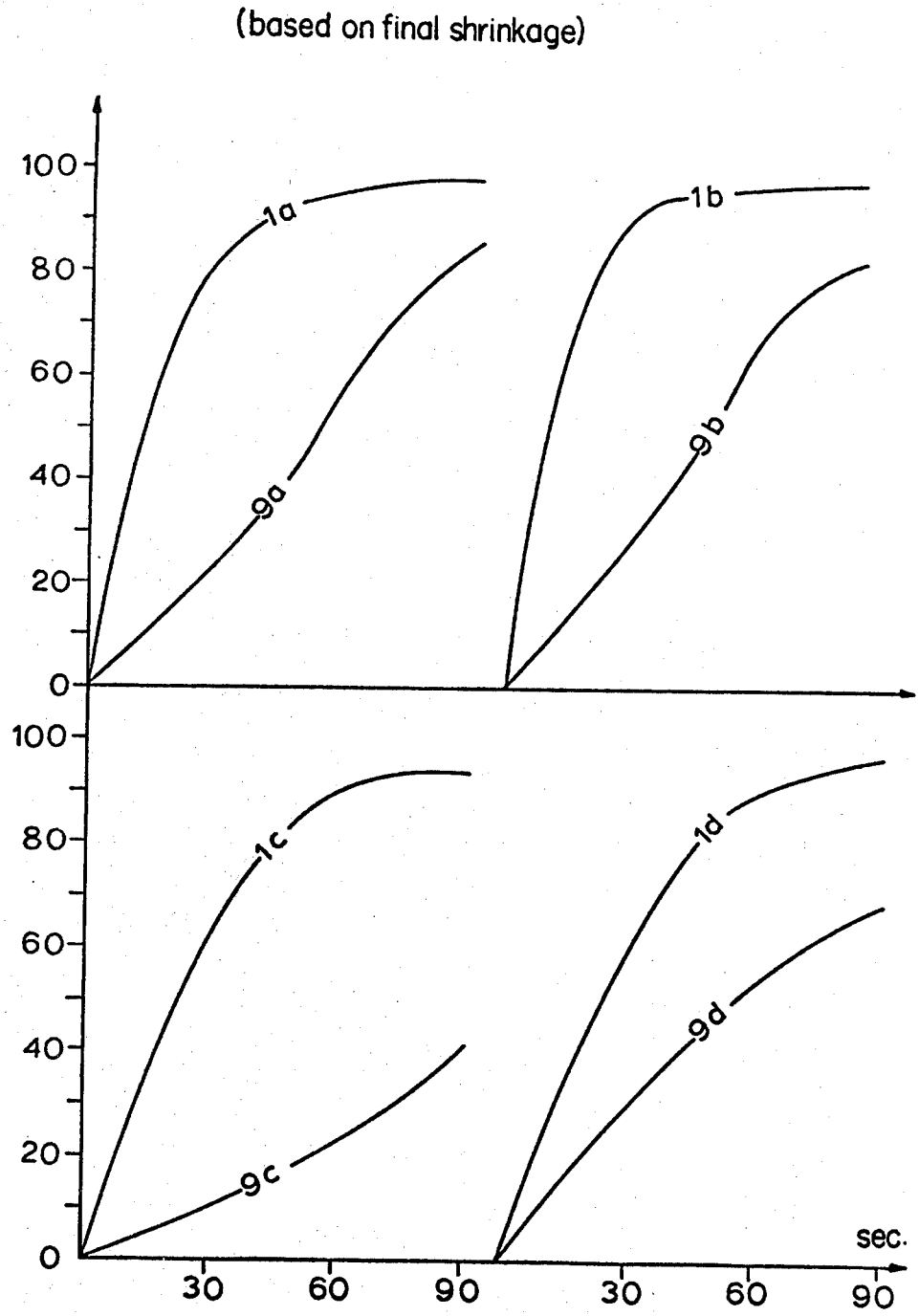
FIG. 2 is an X-Y plot of the data for percentage shrinkage per second, based on final shrinkage for the present invention versus the prior art as taken from Tables 5–8.
Figure 3:
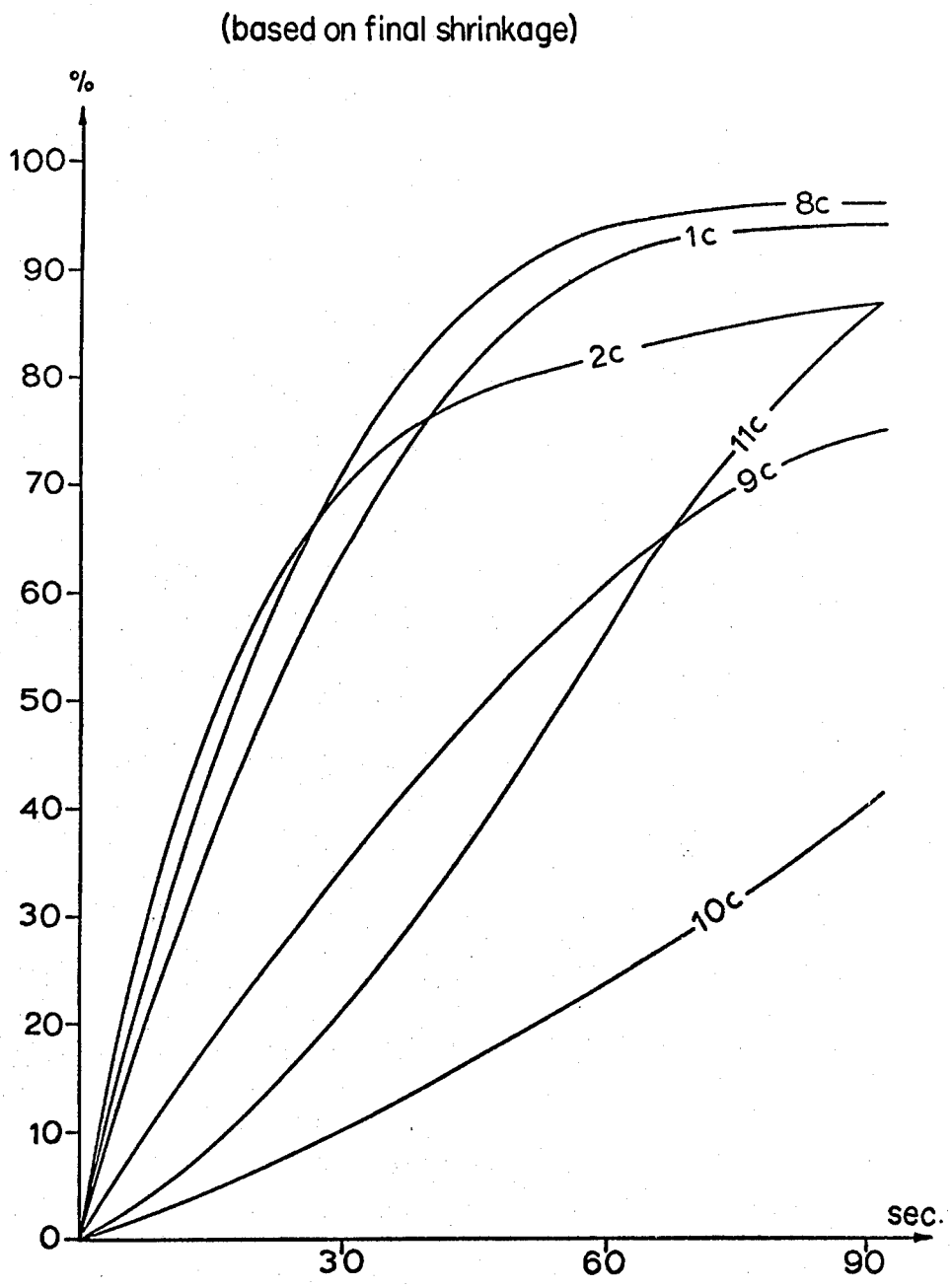
FIG. 3 is an X-Y plot of the data for percentage shrinkage per second, based on final shrinkage for the present invention versus the prior art as taken from Table 7.
Figure 4:
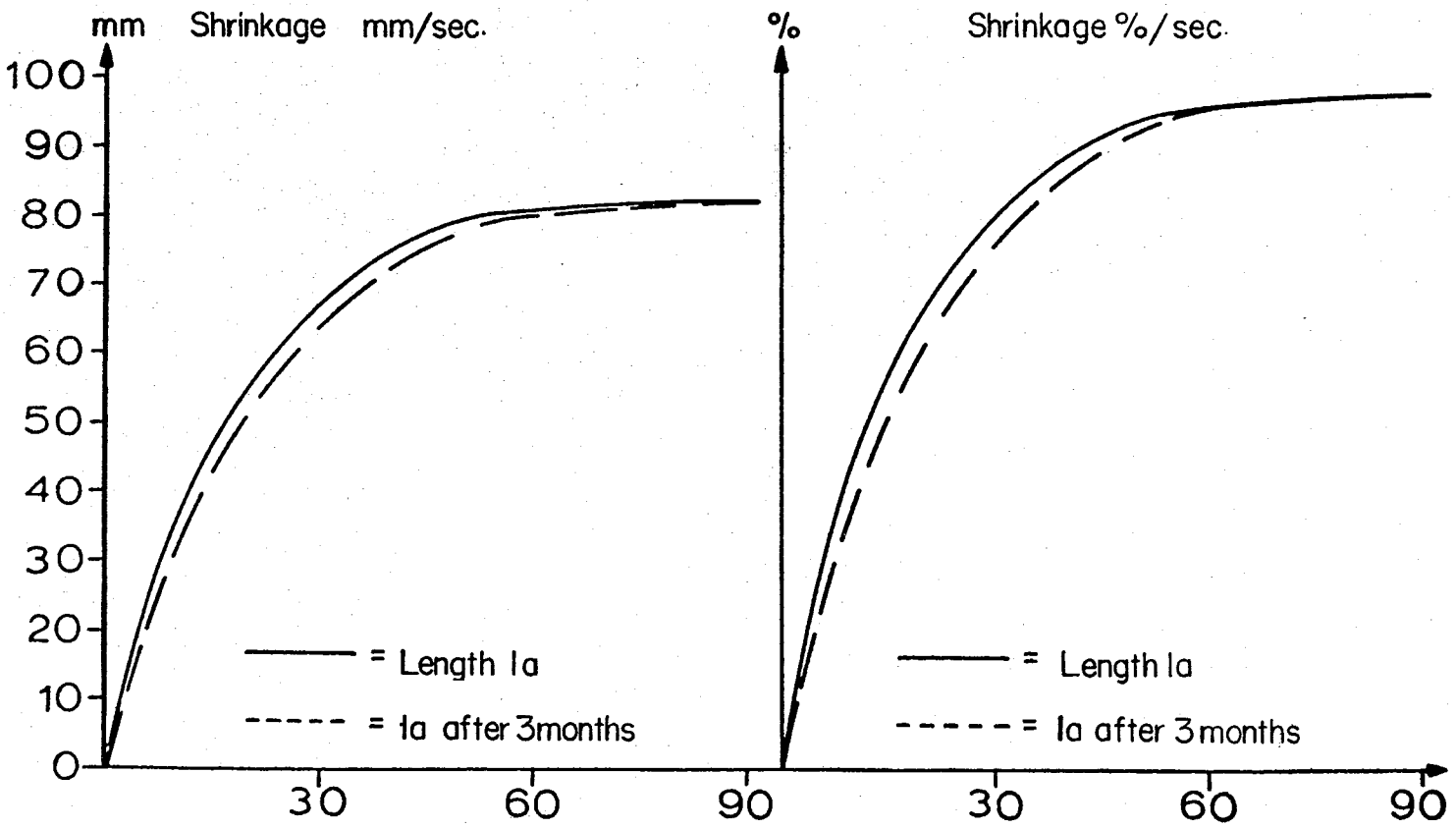
FIG. 4 shows X-Y plots of the shrinkage in mm per second and percentage shrinkage per second for the present invention at the beginning and after three months.

As can be seen from FIG. 4, the agents to be used in accordance with the invention effect, as required in practice, a very good alkali resistance over longer periods of time without a reduction in the wetting capability of the alkali solution, i.e. they are absolutely resistant to hydrolysis.

Figure 5:
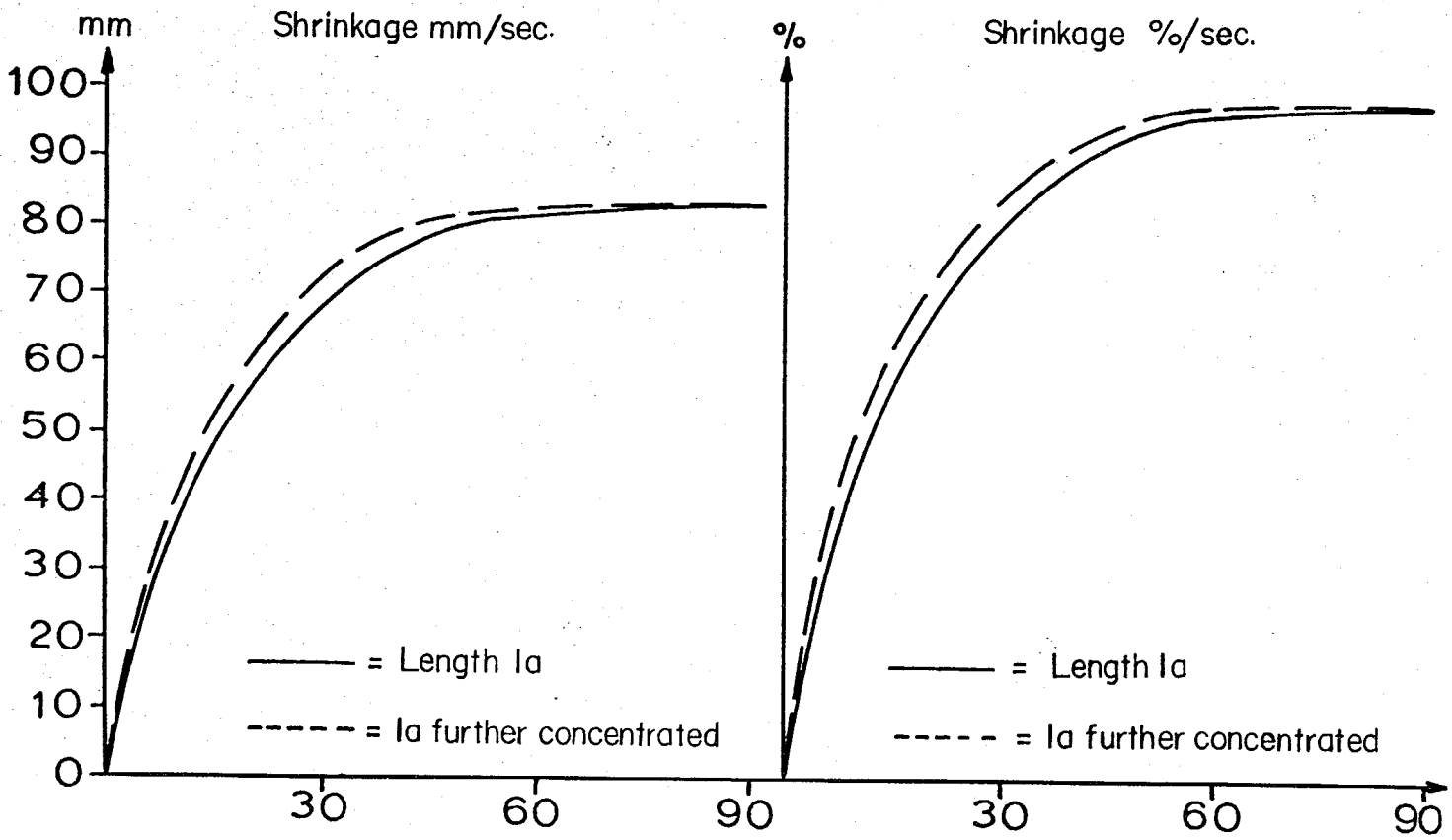
FIG. 5 shows X-Y plots of the shrinkage in mm per second and percentage shrinkage per second for the present invention at the beginning and after further concentration of the alkali solution.

FIG. 5 shows that the wetting agents to be used in accordance with the present invention make it possible to concentrate (evaporate) the alkali solution several times, since they are, as desired, not steam-volatile, but they are resistant against boiling alkali solutions. This property displayed by the wetting agents is absolutely required for the wet mercerization.

Additionally, the compounds to be employed according to the present invention, show an excellent dispersing and dirt-loosening capacity, which has an advantageous effect above all during the treatment with the alkali solution and during the mercerizing of raw cotton.

The agents to be utilized in accordance with the present invention, furthermore, have the great advantage over the customary mixtures of the prior art that they are fully effective already without adding auxiliary agents; in other words, it is possible according to the present invention to operate with absolute substance uniformity. As a consequence, it is impossible for the lye to be nonuniformly depleted of wetting agents and auxiliary agents (due to absorption processes which are hard to control).

A significant advantage of the agents to be used in accordance with the present invention, is, finally, that they can be manufactured from readily accessible, inexpensive raw materials in an economical manner.

The alkene sulfonates to be used in accordance with the present invention are produced from branched alkenes having 1 to 2 branches and containing 6–10 carbon atoms. Examples of branched olefins having 1 to 2 branches and 1 to 3 carbon atoms per branch as starting materials are: tripropylene, 2-ethylhexene, 3-methyl-2-heptene, These starting materials can be reacted by following one of the conventional methods with $SO_3$ and/or complexed $SO_3$ to alkene sulfonates. A detailed description of the manufacturing possibilities is found in "Tenside" [Tensides] 4 (1967): 286 et seq., author: F. Püschel.

The production of tripropylene is described, for example, in: Winnacker and Küchler, "Chem. Technologie" [Chemical Technology] 3: Org. Technology I, p. 722 (1959), Carl Hauser publishers, Munich.

The following description relates to several specific examples for the production of alkene sulfonates to be employed according to the present invention.

SULFONATION WITH COMPLEXED SULFUR TRIOXIDE

An agitator-equipped flask is charged with 2 moles of 2-ethyl-1-hexene and 500 ml. of dichloroethane and at 30°–35° C. a $SO_3$ dioxane complex (2.3 moles of $SO_3$/300 ml. of dioxane) is added in incremental portions within 45 minutes. After an additional agitating period of 4½ hours, the reaction product is freed of solvent at 40° C. by means of a water-jet aspirator and thereafter neutralized with sodium hydroxide solution. Residues of solvent are removed by a brief cursory distilling step. The slightly colored sulfonate solution, which still contains minor amounts of an inorganic salt, can be made of a lighter tint, if desired, with hydrogen peroxide up to an iodine color number of 1 (based on a 5% solution). Yield: 87%.

SULFONATION WITH COMPLEX SULFUR TRIOXIDE

An agitator-equipped flask is charged with 2 moles of a mixture of 30% 2-ethyl-1-hexene, 44% 3-methyl-2-heptene, and 26% 3-methyl-3-heptene, dissolved in 500 ml. of dichloroethane. At 30° C., a $SO_3$-dioxane complex (2 moles of $SO_3$/250 ml. of dioxane) is added thereto in incremental portions within 50 minutes. After an additional agitation time of 4½ hours, the charge is neutralized. The aqueous phase is separated, and residues of solvent are removed by a brief cursory distillation. Iodine color number (based on a 5% solution): 4.7; Yield: 92%.

SULFONATION WITH FREE SULFUR TRIOXIDE

An agitator-equipped flask is charged with 2 moles of 2-ethyl-1-hexene and heated to 40° C. Thereafter, a mixture of 2 moles of $SO_3$ in 2,000 ml. of dichloroethane is added dropwise within 2 hours. After a post reaction time of 4 hours, the charge is neutralized, the aqueous phase is separated and freed of residual amounts of solvent by cursory distillation. Iodine color number of a 5% solution: 2.4; Yield 90%.

Specific examples of the alkali salts of alkene sulfonic acids useful in the present invention include the alkene sulfonate sodium salt from 2-ethyl-1-hexene, the alkene sulfonate sodium salt from tripropylene, the alkene sulfonate sodium salt from 3-methyl-2-heptene, the alkene sulfonate sodium salt from 3-methyl-3-heptene, the alkene sulfonate potassium salt from 2-ethyl-1-hexene, the alkene sulfonate potassium salt from tripropylene, the alkene sulfonate potassium salt from 3-methyl-2-heptene, the alkene sulfonate potassium salt from 3-methyl-3-heptene, the alkene sulfonate lithium salt from 2-ethyl-1-hexene, the alkene sulfonate lithium salt from tripropylene, the alkene sulfonate lithium salt from 3-methyl-2-heptene, the alkene sulfonate lithium salt from 3-methyl-3-heptene.

The agents to be used according to the present invention are intended primarily for lye and mercerizing solutions.

The wetting capability of the olefin sulfonates of the present invention was tested in a modified device according to Hintzmann described in "Melliand Textilbericht" [Melliand Textile Report] (1973) 10: 1,112 and in German Industrial Standard DIN 53,987 (August 1971).

The operation was conducted with a lye volume of 450° cc. and at a lye temperature of 20° C. The raw cotton yarn (Nm 34) utilized had, double-scutched, a hank length of 25 cm. and a weight of (1.0±0.1) grams. The yarn hanks which were stored immediately prior to testing for 24 hours in a normal climate according to 20/65 DIN 50 014 had a load exerted thereon of respectively 20.0 grams.

The effectiveness of the wetting ability of the products according to the present invention in the various test lyes was determined by the shrinking velocity of the thustreated cotton yarn. The longitudinal shrinkage was measured after respectively 30, 60, 90, 120, and 150 seconds of treatment, corresponding to the requirement for a short-term treatment posed under practical conditions. The reference value is the final shrinkage obtained after a treatment period of 10 minutes.

The shrinkage values obtained during the testing process are indicated by tables and graphs. For comparison purposes, the tests included α-olefin sulfonates made of diisobutene, 1-hexene, 1-octene, and 1-dodecene, 2-ethylhexyl sulfate, and three commercial lye and mercerizing wetting agents.

The test lyes employed contained in:

| | |
|---|---|
| Lyes 1a–11a | 270 g. of sodium hydroxide per liter |
| Lyes 1b–11b | 300 g. of sodium hydroxide per liter |
| Lyes 1c–11c | 330 g. of sodium hydroxide per liter |
| Lyes 1d–11d | 360 g. of sodium hydroxide per liter |

and the anhydrous products set forth below:

| | |
|---|---|
| Lyes 1a–1d | 2 g. of olefin sulfonate Na salt from 2-ethyl-1-hexene (according to the invention) |
| Lyes 2a–2d | 2 g. of olefin sulfonate Na salt from tripropylene (according to the invention) |
| Lyes 3a–3d | 2 g. of olefin sulfonate Na salt from diisobutene (for comparison) |
| Lyes 4a–4d | 2 g. of olefin sulfonate Na salt from 1-hexene (for comparison) |
| Lyes 5a–5d | 2 g. of olefin sulfonate Na salt from 1-octene (for comparison) |
| Lyes 6a–6d | 2 g. of olefin sulfonate Na salt from 1-dodecene (for comparison) |
| Lyes 7a–7d | 2 g. of 2-ethylhexyl sulfate Na salt (for comparison) |
| Lyes 8a–8d | 1.8 g of olefin sulfonate Na salt from 2-ethyl-1-hexene +0.2 g. of n-hexanol (according to the invention) |
| Lyes 9a–9d | 2 g. of commercial product A (prior art) |
| Lyes 10a–10d | 2 g. of commercial product B (prior art) |
| Lyes 11a–11d | 2 g. of commercial product C (prior art) |

Commercial products A, B, and C, according to data provided by the manufacturers, are mixtures of anionic surfactants (sulfates and/or alkanesulfonates) and auxiliary agents.

TABLE 1

Lye (270 g. of NaOH per Liter)

| | Shrinkage of the Yarn Length in mm./sec. | | | | | | | in %/sec. | | | |
|---|---|---|---|---|---|---|---|---|---|---|---|
| | 0 | 30 | 60 | 90 | 120 | 150 | 10 Min. | 30 | 60 | 90 | Remarks |
| 1a | 250 | 180 | 169 | 167 | 166 | 166 | 165 | 28.0 | 32.4 | 33.1 | Acc. to Invention |
| 2a | 250 | 182 | 178 | 177 | 176 | 175 | 174 | 27.2 | 28.7 | 29.2 | Acc. to Invention |
| 3a–6a | Ineffective and/or Immeasureable | | | | | | | — | — | — | For Comparison |
| 7a | 250 | 233 | 215 | 204 | 195 | 191 | 181 | 6.8 | 14.0 | 18.3 | For Comparison |
| 8a | 250 | 172 | 166 | 165 | 164 | 164 | 164 | 31.2 | 33.6 | 34.0 | Acc. to Invention |
| 9a | 250 | 191 | 179 | 172 | 169 | 167 | 165 | 23.6 | 28.4 | 31.2 | Prior Art |
| 10a | 250 | 229 | 199 | 178 | 170 | 168 | 166 | 8.4 | 20.4 | 28.8 | Prior Art |
| 11a | 250 | 176 | 170 | 170 | 169 | 169 | 167 | 29.6 | 32.0 | 32.0 | Prior Art |

Table 2

Lye 300 g. of NaOH per Liter)

| | Shrinking of the Yarn Length in mm./sec. | | | | | | | in %/sec. | | | |
|---|---|---|---|---|---|---|---|---|---|---|---|
| | 0 | 30 | 60 | 90 | 120 | 150 | 10 Min. | 30 | 60 | 90 | Remarks |
| 1b | 250 | 178 | 175 | 174 | 173 | 173 | 173 | 28.8 | 30.0 | 30.4 | Acc. to Invention |
| 2b | 250 | 179 | 172 | 170 | 169 | 169 | 168 | 28.4 | 31.2 | 32.0 | Acc. to Invention |
| 3b–7b | Ineffective and/or Immeasureable | | | | | | | — | — | — | For Comparison |
| 8b | 250 | 176 | 171 | 169 | 169 | 169 | 169 | 29.6 | 31.6 | 32.4 | Acc. to Invention |
| 9b | 250 | 189 | 174 | 172 | 171 | 171 | 170 | 24.4 | 30.4 | 31.2 | Prior Art |
| 10b | 250 | 225 | 192 | 181 | 174 | 171 | 169 | 10.0 | 23.2 | 27.6 | Prior Art |
| 11b | 250 | 181 | 172 | 171 | 170 | 170 | 168 | 27.6 | 31.2 | 32.0 | Prior Art |

Table 3

Lye (330 g. of NaOH per Liter)

| | Shrinkage of the Yarn Length in mm./sec. | | | | | | | in %/sec. | | | |
|---|---|---|---|---|---|---|---|---|---|---|---|
| | 0 | 30 | 60 | 90 | 120 | 150 | 10 Min. | 30 | 60 | 90 | Remarks |
| 1c | 250 | 198 | 177 | 175 | 174 | 173 | 170 | 20.8 | 29.2 | 30.0 | Acc. to Invention |
| 2c | 250 | 192 | 182 | 174 | 170 | 169 | 167 | 23.2 | 27.2 | 30.4 | Acc. to Invention |
| 3c–7c | Ineffective and/or Immeasureable | | | | | | | — | — | — | For Comparison |
| 8c | 250 | 191 | 172 | 170 | 169 | 169 | 167 | 23.6 | 30.4 | 31.2 | Acc. to Invention |
| 9c | 250 | 220 | 199 | 188 | 181 | 178 | 167 | 12.0 | 20.3 | 24.8 | Prior Art |
| 10c | 250 | 241 | 230 | 216 | 200 | 191 | 171 | 3.6 | 8.0 | 13.7 | Prior Art |
| 11c | 250 | 232 | 201 | 179 | 173 | 171 | 165 | 7.2 | 19.6 | 29.4 | Prior Art |

TABLE 4

Lye
(360 g. of NaOH per Liter)

| | Shrinkage of the Yarn Length in mm./sec. | | | | | | | in %/sec. | | | |
|---|---|---|---|---|---|---|---|---|---|---|---|
| | 0 | 30 | 60 | 90 | 120 | 150 | 10 Min. | 30 | 60 | 90 | Remarks |
| 1d | 250 | 203 | 178 | 173 | 172 | 172 | 171 | 18.8 | 28.7 | 30.7 | Acc. to Invention |
| 2d | 250 | 229 | 190 | 177 | 172 | 170 | 168 | 8.4 | 24.1 | 29.2 | Acc. to Invention |
| 3d–7d | Ineffective and/or immeasureable | | | | | | | — | — | — | For Comparison |
| 8d | 250 | 197 | 171 | 167 | 166 | 165 | 164 | 21.2 | 31.6 | 33.2 | Acc. to Invention |
| 9d | 250 | 225 | 206 | 193 | 188 | 185 | 169 | 10.0 | 17.6 | 22.8 | Prior Art |
| 10d | 250 | 242 | 230 | 211 | 198 | 186 | 167 | 3.2 | 8.0 | 15.6 | Prior Art |
| 11d | Failed, immeasureable | | | | | | | — | — | — | Prior Art |

TABLE 5

Lye
(270 g. of NaOH per Liter)

| | Shrinkage in mm./sec. | | | | | | Shrinkage in % (Based on Final Shrinkage) | | | |
|---|---|---|---|---|---|---|---|---|---|---|
| | 30 | 60 | 90 | 120 | 150 | 10 Min. | 30 | 60 | 90 | Remarks |
| 1a | 70 | 81 | 83 | 84 | 84 | 85 | 82.3 | 95.3 | 97.5 | Acc. to Invention |
| 2a | 68 | 72 | 73 | 74 | 74 | 76 | 89.8 | 94.7 | 95.9 | Acc. to Invention |
| 3a–6a | Ineffective and/or sparingly soluble | | | | | | — | — | — | For Comparison |
| 7a | 17 | 35 | 46 | 55 | 59 | 69 | 24.6 | 50.8 | 66.4 | For Comparison |
| 8a | 78 | 84 | 85 | 86 | 86 | 86 | 90.7 | 97.7 | 97.7 | Acc. to Invention |
| 9a | 59 | 71 | 78 | 81 | 83 | 85 | 69.3 | 83.5 | 91.7 | Prior Art |
| 10a | 21 | 51 | 72 | 80 | 82 | 84 | 25.0 | 60.7 | 85.5 | Prior Art |
| 11a | 74 | 80 | 81 | 82 | 83 | 85 | 87.2 | 94.0 | 95.3 | Prior Art |

TABLE 6

Lye
(300 g. of NaOH per Liter)

| | Shrinkage in mm./sec. | | | | | | Shrinkage in % (Based on Final Shrinkage) | | | |
|---|---|---|---|---|---|---|---|---|---|---|
| | 30 | 60 | 90 | 120 | 150 | 10 Min. | 30 | 60 | 90 | Remarks |
| 1b | 72 | 75 | 76 | 77 | 77 | 78 | 92.4 | 96.3 | 97.5 | Acc. to Invention |
| 2b | 71 | 78 | 80 | 81 | 81 | 82 | 86.6 | 93.8 | 97.5 | Acc. to Invention |
| 3b–7b | Ineffective and/or sparingly soluble | | | | | | — | — | — | For Comparison |
| 8b | 74 | 79 | 81 | 81 | 81 | 81 | 91.4 | 98.2 | 100.0 | Acc. to Invention |
| 9b | 61 | 76 | 78 | 79 | 79 | 80 | 76.3 | 95.3 | 97.5 | Prior Art |
| 10b | 25 | 58 | 69 | 76 | 79 | 83 | 30.2 | 70.0 | 83.1 | Prior Art |
| 11b | 69 | 78 | 79 | 80 | 80 | 82 | 83.9 | 95.0 | 96.2 | Prior Art |

TABLE 7

Lye
(330 g. of NaOH per Liter)

| | Shrinkage in mm./sec. | | | | | | Shrinkage in % (Based on Final Shrinkage) | | | |
|---|---|---|---|---|---|---|---|---|---|---|
| | 30 | 60 | 90 | 120 | 150 | 10 Min. | 30 | 60 | 90 | Remarks |
| 1c | 52 | 73 | 75 | 76 | 77 | 80 | 65.1 | 91.3 | 93.7 | Acc. to Invention |
| 2c | 58 | 68 | 76 | 80 | 81 | 83 | 70.1 | 81.7 | 91.6 | Acc. to Invention |
| 3c–7c | Ineffective and/or sparingly soluble | | | | | | — | — | — | For Comparison |
| 8c | 59 | 76 | 78 | 79 | 79 | 81 | 72.8 | 93.9 | 96.3 | Acc. to Invention |
| 9c | 30 | 51 | 62 | 69 | 72 | 83 | 36.2 | 61.5 | 74.7 | Prior Art |
| 10c | 9 | 20 | 34 | 50 | 59 | 81 | 11.1 | 24.7 | 41.8 | Prior Art |
| 11c | 18 | 49 | 71 | 77 | 79 | 85 | 21.3 | 57.9 | 83.7 | Prior Art |

TABLE 8

Lye
(360 g. of NaOH per Liter)

| | Shrinkage in mm./sec. | | | | | | Shrinkage in % (Based on Final Shrinkage) | | | |
|---|---|---|---|---|---|---|---|---|---|---|
| | 30 | 60 | 90 | 120 | 150 | 10 Min. | 30 | 60 | 90 | Remarks |
| 1d | 47 | 72 | 77 | 78 | 78 | 79 | 59.5 | 91.1 | 97.3 | Acc. to Invention |
| 2d | 31 | 60 | 73 | 78 | 80 | 82 | 37.9 | 73.2 | 89.0 | Acc. to Invention |
| 3d–7d | Ineffective and/or sparingly soluble | | | | | | — | — | — | For Comparison |
| 8d | 53 | 79 | 83 | 84 | 85 | 86 | 61.5 | 92.0 | 96.5 | Acc. to Invention |
| 9d | 25 | 44 | 57 | 62 | 65 | 81 | 31.0 | 54.3 | 70.5 | Prior Art |
| 10d | 8 | 20 | 39 | 52 | 64 | 83 | 9.6 | 24.1 | 47.0 | Prior Art |
| 11d | Failed, immeasureable | | | | | | — | — | — | Prior Art |

We claim:

1. In an aqueous alkaline bath composition comprising about 100–450 grams per liter of a compound selected from the group consisting of sodium hydroxide, potassium hydroxide, lithium hydroxide or mixtures thereof, the improvement comprising the addition of about 1 to 5 grams per liter of bath composition of a wetting agent comprising alkali salts of alkene sulfonic acids having 6 to 10 carbon atoms and a branched structure with not more than two branches.

2. The composition of claim 1, wherein said alkali salts of alkene sulfonic acids have 7 to 9 carbon atoms.

3. The composition of claim 1, wherein said addition of a wetting agent is about 2 to 3 grams per liter of bath composition.

4. The composition of claim 1, wherein said alkali salts of alkene sulfonic acids are selected from the group consisting of alkene sulfonate sodium salt from 2-ethyl-1-hexene, alkene sulfonate sodium salt from tripropylene, alkene sulfonate sodium salt from 3-methyl-2-heptene, alkene sulfonate sodium salt from 3-methyl-3-heptene, alkene sulfonate potassium salt from 2-ethyl-1-hexene, alkene sulfonate potassium salt from tripropylene, alkene sulfonate potassium salt from 3-methyl-2-heptene, alkene sulfonate potassium salt from 3-methyl-3-heptene, alkene sulfonate lithium salt from 2-ethyl-1-hexene, alkene sulfonate lithium salt from 2-ethyl-1-hexene, alkene sulfonate lithium salt from tripropylene, alkene sulfonate lithium salt from 3-methyl-2-heptene and alkene sulfonate lithium salt from 3-methyl-3-heptene.

5. The composition of claim 1, wherein said branches have 1 to 3 carbon atoms.

6. In a method of mercerizing cellulose fibers by passing said fibers through an aqueous alkalene bath composition comprising about 100–450 grams per liter of a compound selected from the group consisting of sodium hydroxide, potassium hydroxide, lithium hydroxide and mixtures thereof, the improvement comprising:

adding to said bath composition a wetting agent in a concentration of about 1 to 5 grams per liter of said bath composition, said wetting agent comprising alkali salts of alkene sulfonic acids having 6 to 10 carbon atoms, a branched structure with not more than two branches and said branches having 1 to 3 carbon atoms.

7. The method of claim 6, wherein said alkali salts of alkene sulfonic acids are selected from the group consisting of alkene sulfonate sodium salt from 2-ethyl-1-hexene, alkene sulfonate sodium salt from tripropylene, alkene sulfonate sodium salt from 3-methyl-2-heptene, alkene sulfonate sodium salt from 3-methyl-3-heptene, alkene sulfonate potassium salt from 2-ethyl-1-hexene, alkene sulfonate potassium salt from tripropylene, alkene sulfonate potassium salt from 3-methyl-2-heptene, alkene sulfonate potassium salt from 3-methyl-3-heptene, alkene sulfonate lithium salt from 2-ethyl-1-hexene, alkene sulfonate lithium salt from tripropylene, alkene sulfonate lithium salt from 3-methyl-2-heptene and alkene sulfonate lithium salt from 3-methyl-3-heptene.

8. The method of claim 6, wherein said concentration of wetting agent is about 2 to 3 grams per liter of bath composition.

9. The method of claim 6, wherein said alkali salts of alkene sulfonic acids have 7 to 9 carbon atoms.

* * * * *